US006047777A

United States Patent [19]

Eisenbeiss et al.

[11] Patent Number: 6,047,777

[45] Date of Patent: Apr. 11, 2000

[54] METHOD AND DEVICE FOR SUPPRESSING AN EXPLOSION-LIKE FIRE, IN PARTICULAR OF HYDROCARBONS

[75] Inventors: Arthur Alexander Eisenbeiss, Linz; Reinhard Zierler, Micheldorf, both of Austria

[73] Assignee: Intertechnik Techn. Produktionen - Gesellschaft m.b.H., Linz, Austria

[21] Appl. No.: 09/174,530

[22] Filed: Oct. 16, 1998

Related U.S. Application Data

[62] Division of application No. 08/809,452, Apr. 18, 1997, Pat. No. 5,899,277.

[51] Int. Cl.[7] ..... A62C 37/10

[52] U.S. Cl. ..... 169/60; 169/28

[58] Field of Search ..... 169/56, 60, 61, 169/5, 19, 26, 28, 29

[56] References Cited

U.S. PATENT DOCUMENTS

| | | | |
|---|---|---|---|
| 3,523,583 | 8/1970 | Poitras et al. | 169/28 |
| 3,773,111 | 11/1973 | Dunn | 169/26 |
| 3,990,518 | 11/1976 | Hemme | 169/60 |
| 4,013,128 | 3/1977 | Davis | 169/61 |
| 4,359,097 | 11/1982 | Claussen | 169/61 |
| 4,776,403 | 10/1988 | Lejosne | 169/61 |
| 5,224,550 | 7/1993 | Bragg | 169/26 X |

FOREIGN PATENT DOCUMENTS

| | | | |
|---|---|---|---|
| 53948 | 11/1990 | Austria . | |
| 0661081 | 7/1995 | European Pat. Off. . | |
| 1455739 | 5/1969 | Germany . | |
| 2213751 | 9/1973 | Germany . | |
| 153838 | 11/1983 | U.S.S.R. | 169/29 |
| WO 89/01804 | 3/1989 | WIPO . | |
| WO9309848 | 5/1993 | WIPO . | |
| WO9325276 | 12/1993 | WIPO . | |
| WO9511060 | 4/1995 | WIPO . | |

*Primary Examiner*—Lesley D. Morris
*Attorney, Agent, or Firm*—Collard & Roe, P.C.

[57] ABSTRACT

There are described a method and a device for suppressing an explosion-like fire, in particular of hydrocarbons, by means of a fire extinguishing agent, which under pressure at a speed adapted to the speed of propagation of the fire is distributed in the space directly surrounding the source of the fire. To ensure an efficient fire fighting without adversely influencing the environment, it is proposed to spray water as fire extinguishing agent by atomizing the same to form a water mist in a minimum amount of 0.03 $l/m^3$ from a water reservoir (3) in the space directly surrounding the source of the fire.

5 Claims, 2 Drawing Sheets

Figure 1:
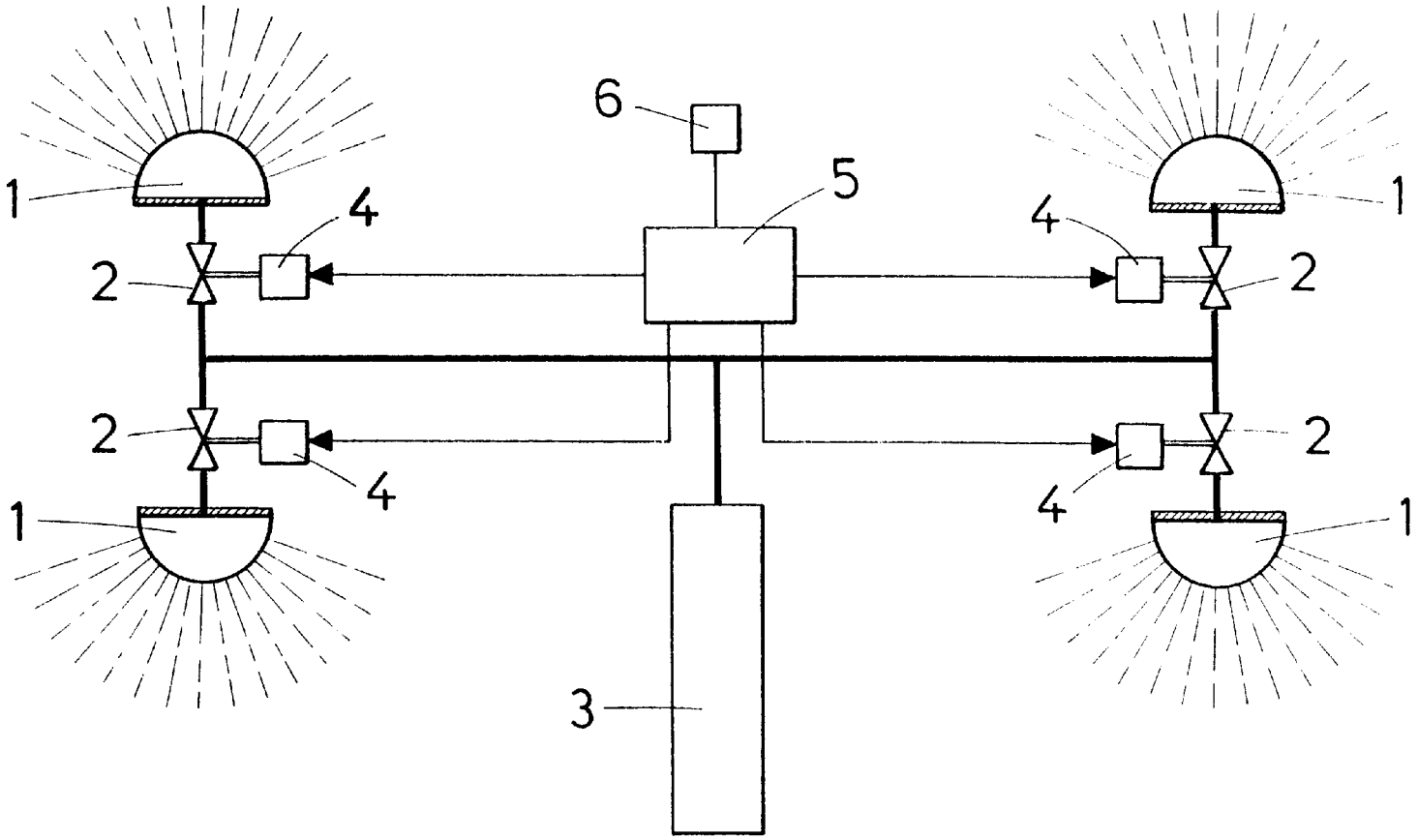

METHOD AND DEVICE FOR SUPPRESSING AN EXPLOSION-LIKE FIRE, IN PARTICULAR OF HYDROCARBONS

This is a divisional application of U.S. application Ser. No. 08/809,452, filed Apr. 18, 1997, now U.S. Pat. No. 5,899,277.

This invention relates to a method of suppressing an explosion-like fire, in particular of hydrocarbons, by means of a fire extinguishing agent which under pressure and with a speed adapted to the speed of propagation of the fire is distributed in the space directly surrounding the source of the fire, and to a device for carrying out such method.

For suppressing explosion-like fires, in particular in vehicles with internal combustion engines, it is known to use carbon halides, which with a speed adapted to the speed of propagation of explosion-like gasoline or oil fires are distributed in the space directly surrounding the source of the fire to be expected. This distribution of the fire extinguishing agent in fractions of a second is achieved by pyrotechnically opening a correspondingly pressurized pressure vessel, from which the carbon halide being used is discharged in the space to be protected under the acting pressure of the vessel. Due to an anticatalytic effect this carbon halide prevents an oxidation which would be sufficient for the propagation of the fire, without expelling the oxygen from the space to be protected to an extent that endangers a survival in this space. What is, however, disadvantageous in the use of such carbon halides is their adverse effect on the environment. In addition, the cooling of the source of the fire achieved in connection with carbon halides is comparatively poor.

It is therefore the object underlying the invention to improve a method of suppressing explosion-like fires, in particular of hydrocarbons, as described above such that a very efficient suppression of the fire can be ensured with an environmentally beneficial fire extinguishing agent.

This object is solved by the invention in that as fire extinguishing agent water possibly mixed with additives is distributed in a minimum amount of 0.03 $l/m^3$ in the space directly surrounding the source of the fire by atomizing it to form a water mist.

The use of water or water mist for fighting a fire is of course known, but not for fighting hydrocarbon fires, where the use of water as fire extinguishing agent was avoided by all means. However, it was surprisingly found out that explosion-like fires of hydrocarbons can also be suppressed very efficiently by means of a water mist, when the water mist from an amount of water of at least 0.03 $l/m^3$ is sprayed in the space directly surrounding the source of the fire. The use of water in the form of a water mist leads to a very large surface of the water droplets as compared to the amount of water used, so that this amount of water evaporates very quickly by taking up a corresponding heat of evaporation, which for fighting the fire involves a very advantageous cooling of the source of the fire, from which this heat of evaporation is withdrawn. This evaporation-related transition from the liquid to the gaseous state of the water droplets is in addition connected with a very large increase in volume (factor 1600), with the effect that the air and thus the oxygen in the direct vicinity of the source of the fire is expelled by the steam produced, which prevents the oxidation required for a propagation of the fire. This expulsion of oxygen must be sufficient, which with the given changes in volume in the transition from the liquid to the gaseous state requires a certain amount of water per unit volume. The droplet size of the water mist does not play a decisive role, as it can be assumed that in a water mist the water droplets do not exceed a certain average size of about 400 $\mu$m, and that with this maximum droplet size the varying rate of evaporation as a result of varying droplet sizes has no decisive influence on the expulsion of oxygen.

What is, however, of major importance in the use of water mist for the suppression of explosion-like fires is the evaporation of the water droplets controlled by the fire itself, which occurs to an increased extent wherever there is an increased evolution of heat. As a result of the increased evaporation of the water mist with the increased evolution of heat, the source of the fire is on the one hand cooled much more in this local area, and on the other hand the oxygen is expelled from this area, which leads to the suppression of the fire. Outside such area of evaporation the water mist atmosphere is maintained, so that a survival in the space thus protected is ensured. In this connection it should be mentioned that the radiant energy of the source of the fire is noticeably reduced by the absorptive effect of the water droplets of the water mist with increasing distance from the source of the fire.

For suppressing an explosion-like fire it is always required that the fire extinguishing agent can be distributed in the vicinity of the source of the fire within a short enough period adapted to the speed of propagation of the fire. This is of course also true for the spraying of water mist. For this purpose, the spraying distance to the source of the fire must be restricted, and a sufficient acceleration of the sprayed water must be ensured, so that the space in the direct vicinity of the source of the fire can be filled with the water mist in the predetermined minimum amount. When the water droplets of the water mist are sprayed with an average speed of at least 5 m/s, preferably at least 10 m/s, at a distance of 1 m from the respective point of atomization, the usual basic conditions as regards the sources of fire to be fought can be satisfied very well. However, the predetermined minimum amount of water volume per unit of space must be ensured by a corresponding number of nozzles.

It need probably not be emphasized particularly that not only pure water, but also water with additives, for instance with an antifreeze agent, can be used. However, the good evaporation of the water must always be ensured.

For carrying out the inventive method there can be provided at least one pressurized water reservoir, which by at least one control valve is connected to nozzles directed against the space directly surrounding the source of fire. To ensure that a water mist in an amount sufficient for the method can be sprayed within a period adapted to the speed of propagation of an explosion-like fire in the space directly surrounding the source of the fire to be expected, at least three, preferably five nozzles per $m^3$ of the space to be filled with water mist should be provided in dependence on the throughput of the nozzles, where the control valves must have a pyrotechnical opening means that can be actuated by a fire detector, so as to ensure an abrupt opening of the control valves and avoid delays in the atomization of the correspondingly pressurized water as a result of the process of opening the control valves. As fire detectors there may be used optoelectronic, thermoelectronic or acoustic sensors.

Another possibility of abruptly starting the atomization of the water from a water reservoir connected to a pressurizing means consists in forming the pressurizing means from a pressure chamber which is open towards the water reservoir and is closed towards the same preferably by a pressure transmission element, in which pressure chamber a propelling charge fitted with an ignition means is provided, so that the propellant gases produced upon igniting the propelling charge effect an expulsion of the water from the water reservoir through the attached nozzles, without having to actuate control valves.

To prevent water from flowing out of the water reservoir through the nozzles, the nozzles might at best be provided with closures opening under a pressure, as this is achieved in the most simple case by a film tearing under a certain pressure. The pressure transmission element between the water reservoir and the pressure chamber does not only effect an advantageous introduction of pressure into the water reservoir, but also prevents a leakage of the propellant gases into the space to be protected through the spray nozzles attached to the water reservoir. To avoid any delay between the detection of the fire and the start of the fire extinction, the ignition means for the propelling charge must be actuated via a fire detector.

Figure 2:
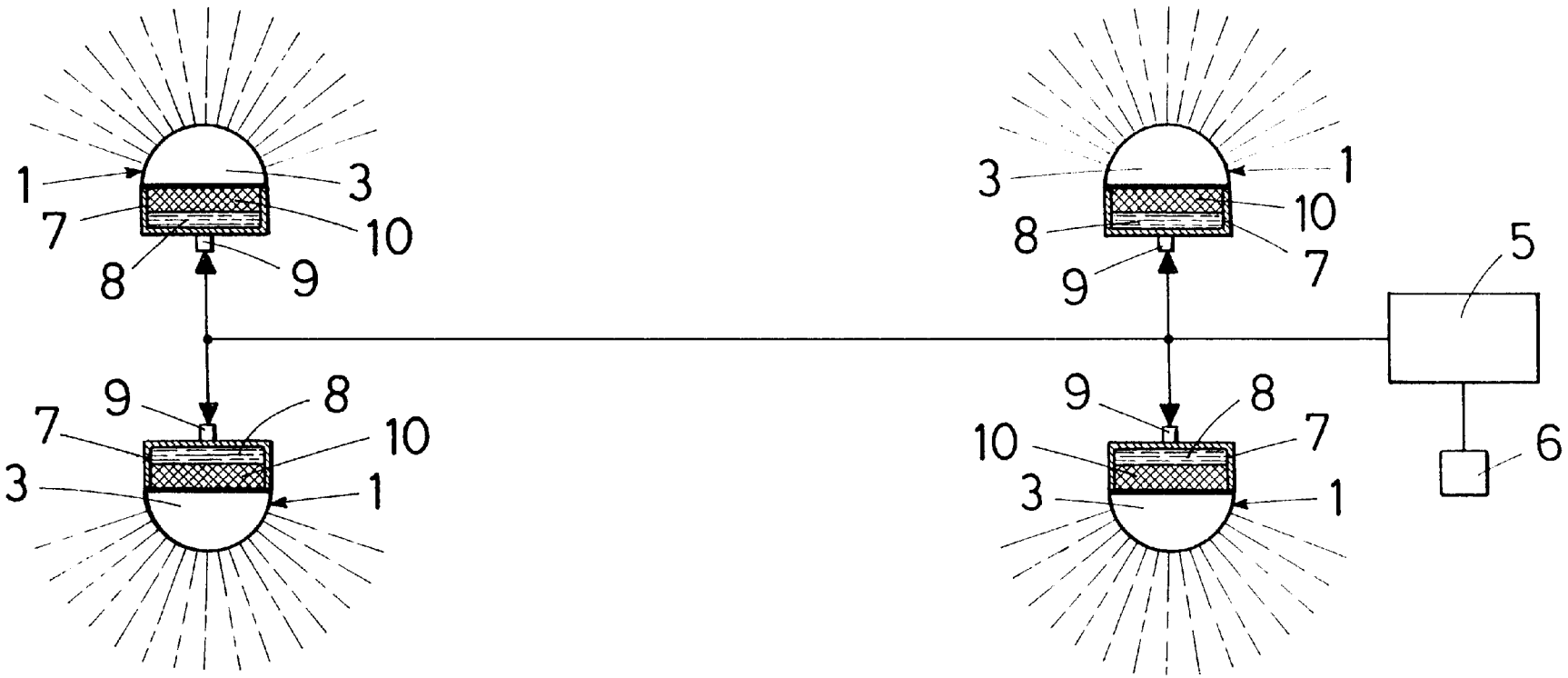

The inventive method of suppressing an explosion-like fire will now be explained in detail with reference to the drawing, wherein:

FIG. 1 shows an inventive device for suppressing an explosion-like fire of hydrocarbons in a simplified block diagram, and FIG. 2 shows an embodiment of an inventive fire suppression device, which has been modified with respect to FIG. 1, likewise in a block diagram.

In accordance with FIG. 1, a plurality of spray heads 1 are connected to a pressurized water reservoir 3 via control valves 2. When the control valves 2 are opened, the pressure acting on the water in the pressurized water reservoir 3 provides for the atomization of the water from the water reservoir 3 in the spray heads 1, which for this purpose are provided with nozzles not represented in detail. For abruptly opening the control valves 2, the same are provided with pyrotechnical opening means 4, which are ignited via a control means 5 when a fire detector 6 responds and the evaluation of the signals of the fire detector 6 results in an actuation of the control valves 2 together or in a certain selection. After the abrupt opening of the control valves 2, the spray heads 1 produce a water mist, which is sprayed into the space directly surrounding the source of the fire, and within a short period, for instance in about 100 ms, should reach a density which corresponds to an amount of water of at least 0.03 $l/m^3$, preferably at least 0.05 $l/m^3$. To be able to satisfy these conditions, all lines including those of the spray heads 1 must be filled with water, a sufficient number of spray heads 1 must be provided, and a sufficient pressure must be applied to the water to be expelled through the spray heads 1. In the case of nozzle openings having a diameter of 1 mm and an appropriate design of the nozzles, an average speed of the mist droplets larger than 10 m/s is achieved at a pressure of 200 bar at a distance of 1 m from the spray heads 1, so that the existing conditions can easily be satisfied. The average diameter of the mist droplets is below 400 $\mu$m, for instance about 200 $\mu$m.

In accordance with FIG. 2 each spray head 1' is provided with a separate water reservoir 3' verging into a pressure chamber 7, which has a propelling charge 8 with an ignition means 9. By means of a pressure transmission element 10, for instance a piston, this propelling charge 8 acts on the water of the water reservoir 3', which upon igniting the ignition means 9 is abruptly sprayed from the spray heads 1'. By the choice of the propelling charge, the pressure acting on the water of the water reservoir 3' and thus the speed of expulsion can be adjusted corresponding to the respective requirements. The ignition signals for the ignition means 9 are provided by a control means 5, which in turn is connected with a fire detector 6 for evaluating the signals received.

The devices illustrated in FIGS. 1 and 2 in their basic configuration can of course also be combined with each other, in that for instance a pressure chamber comprising a propelling charge as proposed in FIG. 2 is associated to the water reservoir 3 in accordance with FIG. 1.

Provided that as a result of the selection and arrangement of the spray heads 1, an at least approximately uniform distribution of the water mist produced in the case of a fire is ensured in the space directly surrounding the source of the fire, the illustrated devices provide for a very efficient suppression also of explosion-like fires of hydrocarbons, without endangering a survival in the spaces to be protected or adversely influencing the environment, because due to the evaporation of the water mist in the direct vicinity of the source of the fire an efficient expulsion of oxygen takes place and at the same time the source of the fire is cooled by withdrawing the heat of evaporation.

We claim:

1. A device for suppressing an explosion-like fire, comprising (a) at least one pressurized reservoir containing water, (b) at least three nozzles directed against a space directly surrounding the source of the fire per cubic meter of the space, (1) the water in the reservoir being under a pressure sufficient to atomize the water in the nozzles and to form a water mist distributed in the space at a velocity corresponding to that of the spreading explosion-like fire, (c) a control for each nozzle to cause the atomized water to pass though the nozzle and to distribute the water mist, and (d) a fire detector connected to the control.

2. The device of claim 1, wherein the control comprises a control valve connecting each nozzle to the pressure reservoir, the control valve including a pyrotechnical opening means, and the fire detector being connected to the pyrotechnical valve opening means for actuating the opening means.

3. The device of claim 1, comprising at least five nozzles per cubic meter of the space.

4. The device of claim 1, wherein a respective one of the reservoirs is provided for each one of the nozzles, and further comprising a pressure chamber extending towards the reservoir, a propelling charge in the pressure chamber, a pressure transmission element arranged between the pressure chamber and the reservoir, the pressure transmission element closing off the pressure chamber, and wherein the control comprises an ignition means for the propelling charge.

5. The device of claim 4, comprising at least five nozzles per cubic meter of the space.

* * * * *

UNITED STATES PATENT AND TRADEMARK OFFICE

CERTIFICATE OF CORRECTION

PATENT NO. : 6,047,777
DATED : April 11, 2000
INVENTOR(S) : EISENBEISS ET AL

It is certified that error appears in the above-identified patent and that said Letters Patent is hereby corrected as shown below:

On the title page, column 1, Item [62], after "5,899,277", please insert

--which was a 371 of PCT/AT95/00205 of 1019/95.

[30] Foreign Application Priority Data

Oct. 20, 1994 [AT] Austria ..... 1972/94--

Signed and Sealed this

Third Day of April, 2001

*Attest:*

Nicholas P. Godici

NICHOLAS P. GODICI

*Attesting Officer*

*Acting Director of the United States Patent and Trademark Office*